US009670570B2

(12) United States Patent
Kristan et al.

(10) Patent No.: US 9,670,570 B2
(45) Date of Patent: Jun. 6, 2017

(54) HIGH CARBON STEEL RAIL WITH ENHANCED DUCTILITY

(71) Applicant: EVRAZ Inc. NA Canada, Regina (CA)

(72) Inventors: Joseph Victor Kristan, Pueblo, CO (US); Gregory Ryan Lehnhoff, Monument, CO (US); Mark David Richards, Pueblo West, CO (US)

(73) Assignee: EVRAZ INC. NA CANADA, Regina, Saskatchewan (CA)

( * ) Notice: Subject to any disclaimer, the term of this patent is extended or adjusted under 35 U.S.C. 154(b) by 611 days.

(21) Appl. No.: 14/255,693

(22) Filed: Apr. 17, 2014

(65) Prior Publication Data

US 2015/0299832 A1 Oct. 22, 2015

(51) Int. Cl.
*C22C 38/02* (2006.01)
*C22C 38/04* (2006.01)
(Continued)

(52) U.S. Cl.
CPC ..... *C22C 38/54* (2013.01); *C21D 1/06* (2013.01); *C21D 1/18* (2013.01); *C21D 6/002* (2013.01);
(Continued)

(58) Field of Classification Search
CPC ..... C22C 38/001; C22C 38/002; C22C 38/02; C22C 38/04; C22C 38/06; C22C 38/14; C22C 38/20; C22C 38/22; C22C 38/24; C22C 38/26; C22C 38/28; C22C 38/30; C22C 38/32; C22C 38/42; C22C 38/44; C22C 38/46; C22C 38/48; C22C 38/50; C22C 38/52; C22C 38/54; C21D 1/18;
(Continued)

(56) References Cited

U.S. PATENT DOCUMENTS 4,426,236 A 1/1984 Sugino
5,658,400 A 8/1997 Uchino
(Continued)

FOREIGN PATENT DOCUMENTS

CA 2222261 10/1997
CA 2800022 12/2011
(Continued)

OTHER PUBLICATIONS

English translation of JP 2001/152290; Jun. 2001; 6 pages.*
(Continued)

*Primary Examiner* — Helene Klemanski
(74) *Attorney, Agent, or Firm* — Pearne & Gordon LLP

(57) ABSTRACT

This invention relates to a high carbon steel rail with enhanced ductility comprising 0.65-1.4 mass % of carbon, 0.1-1.5 mass % of silicon, 0.01-0.4 mass % of manganese, 0.1-1.5 mass % of chromium, and 0.005-0.05 mass % of titanium, with additional allowances for Mo, Nb, V, Cu, M, Co, B, N, Ca, Mg, Zr, Al, and W, with the remainder comprising iron and the inevitable impurities, that displays a head surface hardness of at least 325 HB and a microstructure comprising at least 90% pearlite at a depth of between 2-20 mm below the rail head surface. The invention also relates to the process for manufacturing the high carbon steel rail with enhanced ductility.

12 Claims, 4 Drawing Sheets

(51) Int. Cl.

| | |
|---|---|
| ***C22C 38/06*** | (2006.01) |
| ***C22C 38/14*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C21D 1/18*** | (2006.01) |
| ***C21D 6/00*** | (2006.01) |
| ***C21D 8/00*** | (2006.01) |
| ***C21D 9/04*** | (2006.01) |
| ***C21D 1/06*** | (2006.01) |
| ***C22C 38/00*** | (2006.01) |

(52) U.S. Cl.

CPC ..... *C21D 6/004* (2013.01); *C21D 8/005* (2013.01); *C21D 9/04* (2013.01); *C22C 38/001* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C21D 2211/001* (2013.01); *C21D 2211/009* (2013.01)

(58) Field of Classification Search

CPC ..... C21D 2211/001; C21D 2211/009; C21D 6/002; C21D 6/004; C21D 8/005; C21D 9/04

USPC ..... 148/333, 334, 335, 584

See application file for complete search history.

(56) References Cited

U.S. PATENT DOCUMENTS

| | | | | |
|---|---|---|---|---|
| 5,762,723 | A | 6/1998 | Ueda | |
| 5,830,286 | A | 11/1998 | Ueda | |
| 7,217,329 | B2 | 5/2007 | Cordova | |
| 7,288,159 | B2 | 10/2007 | Cordova | |
| 7,955,445 | B2 | 6/2011 | Honjo | |
| 7,972,451 | B2 | 7/2011 | Ueda | |
| RE42,668 | E | 9/2011 | Ueda | |
| 8,210,019 | B2 * | 7/2012 | Ueda | C21D 9/04 72/342.2 |
| 8,241,442 | B2 | 8/2012 | Bramfitt | |
| 8,361,246 | B2 | 1/2013 | Ueda | |
| 8,361,382 | B2 | 1/2013 | Honjo | |
| 8,404,178 | B2 | 3/2013 | Honjo | |
| 8,469,284 | B2 | 6/2013 | Ueda | |
| 8,747,576 | B2 | 6/2014 | Miyazaki et al. | |
| 8,980,019 | B2 | 3/2015 | Ueda et al. | |
| 2004/0035507 | A1 * | 2/2004 | Cordova | C21D 9/04 148/584 |
| 2007/0181231 | A1 * | 8/2007 | Ueda | C21D 9/04 148/584 |
| 2009/0314049 | A1 * | 12/2009 | Ueda | C21D 9/04 72/364 |
| 2010/0186857 | A1 | 7/2010 | Honjo | |
| 2011/0155821 | A1 * | 6/2011 | Ueda | C22C 38/04 238/150 |
| 2011/0303756 | A1 * | 12/2011 | Ueda | C21D 9/04 238/150 |
| 2013/0065079 | A1 * | 3/2013 | Ueda | C22C 38/02 148/584 |
| 2015/0069141 | A1 * | 3/2015 | Ueda | C21D 9/04 238/150 |
| 2015/0136864 | A1 * | 5/2015 | Ueda | C21D 9/04 238/150 |

FOREIGN PATENT DOCUMENTS

| | | |
|---|---|---|
| CA | 2849133 | * 10/2015 |
| JP | 09316598 | 12/1997 |
| JP | 11350075 | 12/1999 |
| JP | 2001152290 | 6/2001 |
| JP | 2002030341 | 1/2002 |
| JP | 2010185106 | 8/2010 |

OTHER PUBLICATIONS

English translation of JP 2002/030341; Jan. 2002; 5 pages.*

English translation of JP 11/350075; Dec. 1999; 5 pages.*

English translation of JP 09/316598; Dec. 1997; 28 pages.*

Hardness Conversion Chart; https://www.nde-ed.org/GeneralResources/HardnessConv/HardnessConvPrint.pdf; no date available; 3 pages.*

Written Opinion (date of mailing Jul. 28, 2015) from PCT/CA2015/000263.

International Search Report (date of mailing Jul. 28, 2015) from PCT/CA2015/000263.

* cited by examiner

HIGH CARBON STEEL RAIL WITH ENHANCED DUCTILITY

FIELD OF INVENTION

This invention relates to alloy compositions and the method of production of high carbon steel rails in which the combinations of strength, hardness, and ductility are enhanced for use in freight railways.

BACKGROUND TO THE INVENTION

There have been many developments relating to chemical compositions for a variety of grades for carbon steels used in the production of rail products. The rail industry continually moves toward higher axle loads and higher speeds in an effort to increase track efficiency, which emphasizes the demand for improved performance of rail in tracks.

U.S. Pat. No. 5,658,400 describes a high carbon, pearlitic steel rail having high strength, wear resistance, ductility, and toughness that is manufactured by applying special rolling practice to produce fine-grain pearlite blocks in steel containing 0.6-1.2 mass % carbon, 0.1 to 1.20 mass % silicon, 0.40-1.50 mass % manganese and one or more elements selected as required from the group of chromium, molybdenum, vanadium, niobium and cobalt, thus imparting high wear resistance and an elongation of not less than 12% and a V-notch Charpy impact value of not lower than 25 J/cm$^2$, in particular U.S. Pat. No. 5,658,400 indicates that manganese alloy levels below 0.40 mass % do not produce the desired effects.

U.S. Pat. No. 5,762,723, which was reissued as RE 42,668, describes a rail made from steel having improved wear resistance and damage resistance. The patent describes a rail made from a steel having a composition comprising more than 0.85-1.20 mass % of carbon, 0.10-1.00 mass % of silicon, 0.40-1.50 mass % of manganese, and if necessary, at least one member selected from the group consisting of chromium, molybdenum, vanadium, niobium, cobalt, and boron, and retaining high temperature of hot rolling or a steel rail heated to a high temperature for the purpose of heat treatment, to provide a pearlitic steel rail having good wear resistance and good damage resistance, and a method of producing the same, wherein a head portion of the steel rail is cooled at an accelerated rate of 1 to 10° C./sec from an austenite zone temperature to a cooling stop temperature of 700° C. to 500° C. so that the hardness of the head portion is at least 320 HV within the range of a 20 mm depth below the surface of the rail head. U.S. Pat. No. 5,762,723 also indicates that wear resistance generally increases (amount of mass loss due to wear generally decreases) with increasing hardness and decreasing pearlite interlamellar spacing.

Furthermore, U.S. Pat. No. 7,288,159 describes an improved steel for rails, and the methods for producing the same wherein the steel is described as having a carbon content in a range from more than 0.9-1.1 mass % where the high carbon steel rail is characterized as having a pearlitic structure. The average ultimate tensile strength is in a range from 204,860 to 222,120 psi with a minimum of 174,000 psi. The average yield strength was in a range from 132,320 to 148,450 psi with a minimum of 120,000 psi. Moreover, the method describes a fully pearlitic steel rail of high toughness and high wear resistance, consisting essentially of: forging a steel billet comprising the elements in a range from more than 0.9-1.1 mass % of carbon, 0.26-0.80 mass % of silicon, 0.8-1.2 mass % of manganese, less than or equal to 0.35 mass % of chromium, the balance of iron, and residual elements; hot rolling the billet to a rolling finishing temperature of about 1,000° C. and thereby forming a rail, and cooling the rail at a selected cooling rate in the range from 3.3 to 4.3° C./sec beginning substantially at said rolling finishing temperature and continuing at least until the pearlitic transformation completion temperature.

Also, U.S. Pat. No. 7,217,329 describes a steel railroad rail and methods for producing same, having a carbon content in a range from 0.7 to 0.95 mass %, a manganese content in a range from 0.8 to 1.2 mass %, and titanium content in the range of 0.005 to 0.105 mass % that has increased wear resistance and increased fracture toughness over conventional steel rail. The rail is characterized as having a pearlitic structure of a eutectoid nature. The average ultimate tensile strength is in a range from 178,000 to 207,000 psi, with a minimum of 174,000 psi. The average yield strength is in a range from 122,000 to 141,000 psi, with the minimum of 120,000 psi. The average total elongation is in a range from 10.3% to 12.5%, with a minimum of 10.00%. The Brinell hardness on the surface at any position of the head top and upper gage corners of the rail is in a range from 370 to 420 BHN. The hardness 19 mm below the top surface is in a range from 360 to 405 BHN and 19 mm below the surface at the upper gage corners is in a range from 360 to 410 BHN.

Additionally, U.S. Pat. No. 8,361,246 describes a pearlitic rail steel having a composition of 0.65-1.2 mass % of carbon, 0.05-2.00 mass % of silicon, 0.05-2.00 mass % of manganese and the balance composed of iron and inevitable impurities. The pearlitic rail is further specified to have a maximum surface roughness of 180 μm and a minimum ratio of the surface hardness to the maximum surface roughness of 3.5.

As another example, U.S. Pat. No. 8,469,284 describes a rail steel containing 95% pearlite structure below the surface of the rail, demonstrating a maximum manganese sulfide inclusion aspect ratio of 5 below the rail surface, and possessing a head hardness of 320-500 HV. The rail is composed principally of 0.65-1.2 mass % of carbon, 0.05-2.0 mass % silicon, 0.05-2.0 mass % manganese, and 0.0005-0.05 mass % rare earth metals, and, if necessary, one or more selected from suffer, calcium, aluminium, cobalt, chromium, molybdenum, niobium, boron, nickel, titanium, magnesium, zirconium, and nitrogen.

Additionally, U.S. Pat. No. 7,972,451 describes a pearlitic rail steel that is finished rolled between 850-1000° C. with the final pass imposing at least 6% area reduction ratio, wherein accelerated cooling of 2-20° C./s is applied to the rail web and accelerated cooling of 1-10° C./s is applied to the rail head and base to cool the rail from austenite to below 650° C. within 100 seconds of finish hot rolling. The rail processed as described must contain 200 or more pearlite blocks of 1-15 μm size within 0.2 mm$^2$ area at a depth up to 10 mm below the rail surface. Furthermore, the carbon equivalent of the produced rail must exceed the number of proeutectoid cementite networks intersecting two 300 μm long perpendicular lines at the centerline of the rail web. The produced rail contains principally 0.65-1.4 mass % of carbon, 0.05-2.0 mass % of silicon, and 0.05-2.0 mass % of manganese, and further contains, as necessary, one or more of chromium, molybdenum, vanadium, niobium, boron, cobalt, copper, nickel, nitrogen, titanium, magnesium, calcium, aluminium, and zirconium.

Furthermore, U.S. Pat. No. 5,830,286 describes a pearlitic rail containing 0.85-1.2 mass % of carbon, 0.1-1.0 mass % silicon, 0.4-1.5 mass % manganese, and 0.0005-0.004 mass % boron, and further containing, as necessary, one or more of chromium, molybdenum, vanadium, niobium, and cobalt. The described rail must have a minimum hardness of 370 HV at 20 mm below the rail surface and a maximum variation in rail hardness of 30 HV within 20 mm of the rail surface.

Furthermore, U.S. Pat. No. 4,420,236 describes a pearlitic rail containing 0.65-0.85 mass % of carbon, 0.5-1.2 mass % of silicon, 0.5-1.2 mass % of manganese, 0.2-0.9 mass % of chromium, 0.005-0.05 mass % of aluminium, and 0.004-0.05 mass % of one or both niobium and titanium. The rail must also have a surface layer to a depth of 10 mm or more that is composed of fine pearlite with a tensile strength of 120 kg/mm$^2$, a minimum reduction of area of 40%, and a hardness of 350 HV or more.

Moreover, U.S. Pat. No. 8,404,178 describes a pearlitic steel rail with a tensile strength of at least 1200 MPa that contains 0.6-1.0 mass % carbon, 0.1-1.5 mass % silicon, 0.4-2.0 mass % manganese, 0.035 mass % or less of phosphorous, 0.0005-0.0100 mass % sulfur, optionally 0.004 mass % or less of oxygen, optionally 0.001-0.01 mass % of calcium, no more than 2 ppm of hydrogen, and optionally one or more of vanadium, chromium, copper, nickel, niobium, molybdenum, or tungsten. The rail is also such that length of type A inclusions is 250 μm or less and the number of type A inclusions with a length of 1-250 μm is less than 25 per mm$^2$ in the cross-section in the longitudinal direction of the rail head.

Additionally, U.S. Pat. No. 8,361,382 describes a pearlitic steel rail with a tensile strength of at least 1200 MPa that contains 0.6-1.0 mass % of carbon, 0.1-1.5 mass % of silicon, 0.4-2.0 mass % manganese, 0.035 mass % or less of phosphorous, 0.0100 mass % or less of suffer, 0.0010-0.010 mass % of calcium, and 0.004 mass % or less of oxygen. The steel rail can also contain one or more of vanadium, chromium, copper, nickel, niobium, molybdenum, and tungsten. The steel rail is also such that the length of type C inclusions is 50 μm or less and the number of type C inclusions with a length of 1-50 μm is 0.2-10 per mm$^2$ in the cross-section in the longitudinal direction of the rail head.

Furthermore, U.S. Pat. No. 7,955,445 describes a pearlitic rail steel with a hardness of 380-480 HV to a depth of at least 25 mm in the rail head. The steel rail contains 0.73-0.85 mass % of carbon, 0.5-0.75 mass % of silicon, 0.3-1.0 mass % of manganese, 0.035 mass % or less of phosphorous, 0.0005-0.012 mass % of sulfur, and 0.2-1.3 mass % of chromium. The ratio of manganese to chromium in the steel rail is also within 0.3-1.0. According to the invention, the steel rail can also contain one or more of vanadium, copper, nickel, niobium, and molybdenum.

U.S. Pat. No. 8,241,442 describes the method of making a hypereutectoid, head-hardened steel rail that includes head hardening a steel rail having a composition containing 0.86-1.00 mass % carbon, 0.40-0.75 mass % manganese, 0.40-1.00 mass % silicon, 0.05-0.15 mass % vanadium, 0.015-0.030 mass % titanium, and sufficient nitrogen to react with the titanium to form titanium nitride. Furthermore, the patent specifies the range of cooling rates for the head hardening process in terms of coordinates on a plot of the temperature of the head of the steel rail versus cooling time. The upper bound of the cooling rate is defined by the line connecting (0 s, 775° C.), (20 s, 670° C.), and (110 s, 550° C.), and the lower bound of the cooling rate is defined by the line connecting (0 s, 750° C.), (20 s, 610° C.), and (110 s, 500° C.).

Finally, U.S. Patent Application Publication U.S. 2010/0186857 describes a pearlitic rail steel with a hardness of 380-480 HV to a depth of at least 25 mm in the rail head. The steel rail contains 0.73-0.85 mass % of carbon, 0.5-0.75 mass % of silicon, 0.3-1.0 mass % of manganese, 0.035 mass % or less of phosphorous, 0.0005-0.012 mass % of sulfur, 0.2-1.3 mass % of chromium, 0.005-0.12 mass % of vanadium, and 0.0015-0.006 mass % of nitrogen. The ratio of manganese to chromium in the steel rail is also within 0.3-1.0, and the vanadium to nitrogen ratio in the steel rail is within 8.0-30.0. According to the invention, the steel rail can also contain one or more of copper, nickel, niobium, and molybdenum.

Japanese Patent Publication 2002-030341 describes a low strength steel rail with a hardness of 220-300 HB that contains 0.60-0.95 mass % of carbon, 0.10-1.20 mass % of silicon, and 0.20-1.50 mass % of manganese, with allowances for one or more of 0.01-0.50 mass % of chromium, 0.01-0.2 mass % of molybdenum, and 0.1-2.0 mass % of cobalt. The steel rail can also contain one or more of copper, nickel, vanadium, niobium, and titanium, as necessary. The steel rail must also have a carbon equivalent between 0.6-1.0 and receive accelerated cooling of 1 to 2.5° C./s in the 800-500° C. range.

Japanese Patent Publication 2001-152290 describes a low strength steel rail with a hardness of 220-300 HB that contains 0.60-1.20 mass % of carbon, less than 0.2 mass % of silicon, and less than 0.4 mass % of manganese, with a further allowance of 0.01-0.20 mass % of chromium, as long as the sum of silicon, manganese, and chromium is less than 0.5 mass %. The steel rail can also contain one or more of molybdenum, copper, nickel, niobium, vanadium, titanium, and cobalt, as necessary.

Japanese Patent Publication 11350075 describes a pearlitic steel rail containing 0.60-1.20 mass % of carbon, 0.10-0.50 mass % of silicon, 0.30-1.20 mass % of manganese, and 0.0060-0.0200 mass % of nitrogen, with further allowances of one or more of chromium, molybdenum, copper, nickel, niobium, vanadium, cobalt, titanium, and boron.

Japanese Patent Publication 09316598 describes a steel rail containing 0.85-1.20 mass % of carbon, 0.10-1.00 mass % of silicon, 0.20-1.50 mass % of manganese, and 0.05-1.00 mass % of chromium, with further allowances for molybdenum, vanadium, niobium, cobalt, and boron. The steel rail must also possess a hardness of 320 HV or more at a depth of 20 mm and the difference in hardness between the base metal and the weld joint is restricted to 30 HV or less.

Japanese Patent Publication 2010-185106 describes a steel rail containing 0.50-1.0 mass % of carbon, 0.1-1.0 mass % of silicon, 0.1-1.5 mass % of manganese, less than 0.030 mass % of phosphorous, less than 0.020 mass % of sulfur, less than 0.005 mass % of aluminium, 0.25-1.5 mass % of chromium, and less than 0.0020 mass % oxygen, with additional allowances for nickel, molybdenum, and copper, as necessary. The rail also has a calculated specific resistance in the range of 21-24 μΩ cm and a fatigue crack propagation velocity below $2.5\times10^{-8}$ m/cycle at a stress intensity factor of $\Delta K=15$ MPa m$^{1/2}$ at a depth of 10 mm in the rail where the pearlite interlamellar spacing is between 0.08-0.25 μm.

It is an object of this invention to provide improved alloy compositions for steel rail products, particularly for high carbon steel rail products with microstructures comprised principally of pearlite.

It is another object of this invention to provide an improved process of manufacturing steel rail products.

It is an aspect of this invention to provide a high carbon steel rail with enhanced ductility comprising 0.65-1.4 mass % of carbon, 0.1-1.5 mass % of silicon, 0.01-0.3 mass % of manganese, 0.1-1.5 mass % of chromium, and 0.005-0.05 mass % of titanium, with the remainder being iron and the unavoidable impurities. In one embodiment, the carbon content is from 0.65-0.75 mass % to promote intermediate strength and enhanced ductility. In another embodiment, the carbon, content is from 0.75-0.85 mass % to promote high strength and enhanced ductility. In yet another embodiment, the carbon content is from 0.85-1.0 mass % to promote even higher strength and enhanced ductility. In still another embodiment, the carbon content is from 1.0-1.2 mass % to promote even higher strength and enhanced ductility.

It is another aspect of this invention to provide a high carbon steel rail with enhanced ductility comprising 0.65-1.4 mass % of carbon, 0.5-1.5 mass % of silicon, 0.01-0.4 mass % of manganese, 0.1-1.5 mass % of chromium, and 0.005-0.05 mass % of titanium, with the remainder being iron and the unavoidable impurities. In one embodiment, the carbon content is from 0.65-0.75 mass % to promote intermediate strength and enhanced ductility. In another embodiment, the carbon content is from 0.75-0.85 mass % to promote high strength and enhanced ductility. In yet another embodiment, the carbon content is from 0.85-1.0 mass % to promote even higher strength and enhanced ductility. In still another embodiment, the carbon content is from 1.0-1.2 mass % to promote even higher strength and enhanced ductility.

It is another aspect of this invention to incorporate the addition of 0.005-0.05 mass % of titanium to a high carbon steel rail with manganese contents limited to 0.30 mass % or 0.40 mass %, since prior implementations of titanium in high carbon rail steels applied to higher manganese contents of 0.8-1.2 mass % (U.S. Pat. Nos. 7,288,159 and 7,217,329).

It is another aspect of this invention to produce a high carbon steel rail with a microstructure comprising at least 90% pearlite at a depth of between 2-20 mm below the rail head surface.

It is another aspect of this invention to produce a high carbon steel rail with a rail head surface hardness of at least 325 HB (Brinell hardness) for improved wear resistance.

It is another aspect of this invention to provide a high carbon steel rail as described above that further includes up to 0.5 mass % Mo, up to 0.05 mass % Nb, up to 0.3 mass % V, up to 1.0 mass % Cu, up to 1.0 mass % Ni, up to 1.0 mass % Co, up to 0.005 mass % B, up to 0.025 mass % N, up to 0.02 mass % Ca, up to 0.02 mass % Mg, up to 0.2 mass % Zr, up to 1.0 mass % Al, and/or up to 1.0 mass % W. These additional elements can be present in rail steel products for various reasons, but do not affect the novelty of steel rail compositions described above.

Finally, it is an aspect of this invention to provide the method of manufacturing the high carbon steel rail comprising the above compositions and characteristics, where the manufacturing process consists of the steps of: forming a rail shape by rolling of an austenitic structure; cooling of the austenitic structure of the whole rail or any portion of the rail to below the pearlite transformation temperature at a cooling rate sufficient to achieve a hardness of at least 325 HB on the surface of the rail head while generating a microstructure comprising at least 90% pearlite at a depth of between 2-20 mm below the rail head surface, where the austenite structure prior to pearlite transformation is either the austenite structure present after the rolling process or an austenite structure developed by reheating a cooled rail to above the austenite formation temperature, and the cooling is achieved either through ambient cooling and/or accelerated cooling comprising spraying, immersing, and/or flowing a cooling media across the entire surface, or any portion of the surface of the rail; and further cooling the rail to ambient temperature.

These and other objects and features shall now be described in relation to the following drawings and description.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION OF THE INVENTION

Figure 1:
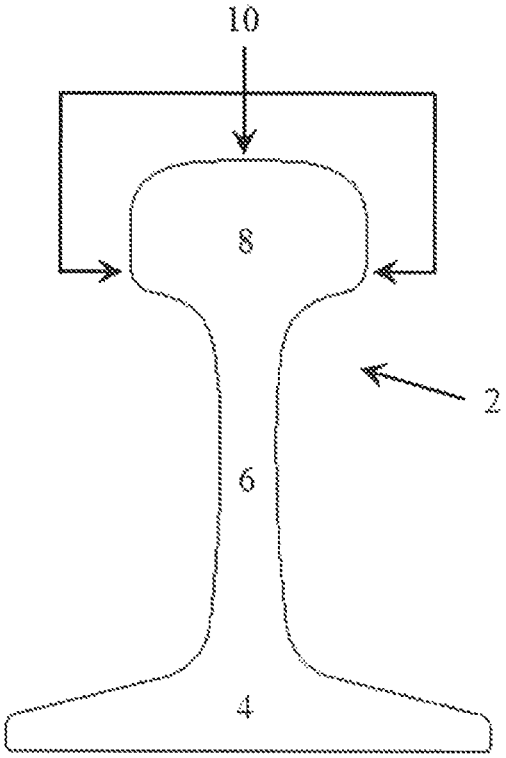
FIG. 1 depicts a schematic drawing of a rail cross section (2) consisting of a base (4), web (6), and head (8). A schematic representation of the rail head surface (10) is also indicated.

Carbon (C) imparts higher strength, higher hardness, and increased wear resistance to steel by producing pearlitic structures. To improve wear resistance and inhibit the initiation of fatigue damage in rails, it is preferable for rail steels to contain 0.65-1.4 mass % of carbon. Carbon contents below 0.65 mass % result in inadequate pearlite characteristics, while carbon contents above 1.4 mass % result in proeutectoid cementite, which is an undesirable microstructure in the steel rail. In order to produce rail steel with an optimal pearlitic microstructure, the carbon content is usually limited to between 0.65-1.4 mass %. To impart intermediate strength and enhanced ductility, certain embodiments of the invention have a carbon content of 0.65-0.75 mass %. Certain other embodiments have a carbon content of 0.75-0.85 mass % to impart high strength and enhanced ductility. Certain other embodiments have a carbon content of 0.85-1.0 mass % to impart even higher strength and enhanced ductility. Still other embodiments have a carbon content of 1.0-1.2 mass % to impart even higher strength and enhanced ductility.

Silicon (Si) is added to deoxidize the steel, to increase the hardenability and refine the pearlite interlamellar spacing, and to inhibit proeutectoid cementite formation, which is an undesirable microstructure in the steel rail. Silicon contents below 0.1 mass % are insufficient to deoxidize the steel while silicon contests above 1.5 mass % increase the hardenability and promote martensite formation, which is an undesirable microstructure in the rail. To optimize the steel microstructure, silicon content is usually limited to 0.1-1.5 mass %. To achieve sufficient deoxidation, pearlite interlamellar spacing refinement and a controlled level of hardenability, certain embodiments of the invention have a silicon content of 0.5-1.5 mass %.

Manganese (Mn) is added to the steel for deoxidation, to form manganese sulfide inclusions that are beneficial for the manufacturing of the rail, and for increased hardenability to refine the pearlite interlamellar spacing. Low alloy rail steels of intermediate and high strength, as specified, by AREMA Chapter 4, contain 0.70-1.25 mass % of manganese. In the present invention, the manganese content is limited in some embodiments to between 0.01-0.40 mass %, and in other embodiments to between 0.01-0.30 mass %, to control the hardenability of the alloy and avoid detrimental non-pearlitic structures. The implementation of substantially reduced manganese levels in the present invention to reduce the hardenability and avoid non-pearlitic structures is novel, and provides the steel rail with excellent combinations of strength and ductility that are not obvious from the prior art.

Chromium (Cr) is added to the steel rail to control the rate of the pearlitic transformation and refine the interlamellar spacing, thereby increasing hardness and wear resistance. To adequately refine the pearlite interlamellar spacing without increasing the hardenability to the extent that martensite is promoted, the chromium content is usually limited to between 0.1-1.5 mass %.

Titanium (Ti) is added to the steel rail to form titanium nitride, titanium carbide, and/or titanium carbo-nitride precipitates that refine the austenite grain size and promote ductility of the steel rail. More specifically the titanium is added to improve or refine the austenite structure. To experience the beneficial effect of titanium precipitation, the titanium content is usually limited to between 0.005-0.05 mass %. The austenite grain refinement due to the titanium addition also serves to reduce the hardenability of the steel rails, and therefore also decreases the susceptibility to brittle martensite formation, which would impair the ductility of the rail. The addition of titanium to the high carbon steel compositions with reduced manganese contents in this invention is novel, since prior implementations of titanium in high, carbon rail steels applied to much higher manganese contents, such as 0.8-1.2 mass % (U.S. Pat. Nos. 7,288,159 and 7,217,329). Because sulfide formation characteristics are dependent on the manganese content, and because sulfides can also contain titanium and/or precipitate in conjunction with titanium nitride particles, it is not obvious from the prior art that titanium additions will be effective at the unique manganese levels utilized in the present invention. The excellent combinations of strength and ductility in the rail steels described in the present invention are therefore unexpected. Generally speaking, titanium residual levels in steels can approach 0.002-0.003 mass %. In other words titanium, can be found in the unavoidable impurities typically found in steel. However, the beneficial properties outlined herein are experienced when the titanium has been added to produce a rail having a range of 0.005 mass % to 0.05 mass % of titanium.

Molybdenum (Mo) increases the hardenability of the steel and refines the pearlite interlamellar spacing, thereby increasing the hardness and wear resistance of the rail. However, if the molybdenum content exceeds 0.5 mass %, martensite, which is detrimental to the ductility and wear resistance of the rail, is likely to form. Therefore, the molybdenum content in the steel rail is limited to 0.5 mass %.

Niobium (Nb) refines the austenite grain structure and improves the ductility of the steel and also strengthens the final pearlitic structure, by precipitating as niobium carbo-nitride. However, if the niobium content exceeds 0.05 mass %, excessive niobium carbo-nitride precipitation occurs and degrades the ductility of the pearlite structure. Therefore, the niobium content in the steel rail is limited to 0.05 mass %.

Vanadium (V) refines the austenite grain structure and improves ductility of the steel, and also strengthens the final pearlitic structure by precipitating as vanadium, carbo-nitride. However, if the vanadium content exceeds 0.3 mass %, excessive vanadium carbo-nitride precipitation occurs and degrades the ductility of the pearlite structure. Therefore, the vanadium content in the steel rail is limited to 0.3 mass %.

Copper (Cu) increases the hardenability of the steel and refines the pearlite interlamellar spacing, thereby increasing the hardness and wear resistance of the rail. However, if the copper content exceeds 1.0 mass %, martensite, which is detrimental to the ductility of the rail, is likely to form. Therefore, the copper content in the steel rail is limited to 1.0 mass %.

Nickel (Ni) improves the toughness of the steel and increases the hardenability of the steel, thereby refining the pearlite interlamellar spacing and increasing the hardness and wear resistance of the rail. However, if the nickel content exceeds 1.0 mass %, martensite, which is detrimental to the ductility of the rail, is likely to form. Therefore, the nickel content in the steel rail is limited to 1.0 mass %.

Cobalt (Co) is a ferrite stabilizing element and therefore promotes austenite decomposition during heat treatment, which may be advantageous in suppressing the formation of undesirable microstructures that are detrimental to the ductility and wear resistance of the steel rail. However, no additional benefit is obtained if the cobalt content exceeds 1.0 mass %. Therefore, the cobalt content in the steel rail is limited to 1.0 mass %.

Boron (B) increases the hardenability of the steel and refines the pearlite interlamellar spacing, thereby increasing the hardness and wear resistance of the rail. However, if the boron content exceeds 0.005 mass %, coarse boro-carbide precipitates may form and degrade the ductility of the rail. Therefore, the boron content in the steel rail is limited to 0.005 mass %.

Nitrogen (N) precipitates in the steel as nitride compounds that refine the austenite grain size of the steel, thereby improving the ductility of the rail. However, if the nitrogen content exceeds 0.025 mass % coarse nitride precipitates may form and degrade the ductility of the rail. Therefore, the nitrogen content in the steel rail is limited to 0.025 mass %.

Calcium (Ca) assists in deoxidizing the liquid steel, and in the solid steel fortifies sulfide inclusions by either substituting for manganese in the inclusions and/or by forming rigid calcium oxides on which the manganese sulfides precipitate, thus decreasing the extent of sulfide elongation during rail rolling and improving the ductility of the rail. However, if the calcium content exceeds 0.020 mass %, coarse calcium oxides are formed, thereby reducing the ductility of the rail. Therefore, the calcium content in the steel rail is limited to 0.020 mass %.

Magnesium (Mg) fortifies sulfide inclusions by either substituting for manganese in the inclusions and/or by forming rigid magnesium oxides on which the manganese sulfides precipitate, thus decreasing the extent of sulfide elongation during rail rolling and improving the ductility of the rail. However, if the magnesium content exceeds 0.020 mass %, coarse magnesium oxides are formed, thereby reducing the ductility of the rail. Therefore, the magnesium content in the steel rail is limited to 0.020 mass %.

Zirconium (Zr) reacts with nitrogen to form stable nitride precipitates that refine the austenite grain size and improve the ductility of the steel. Additionally, zirconium influences the characteristics of sulfide inclusions, further improving the ductility of the steel. However, if the zirconium content exceeds 0.20 mass %, coarse zirconium-containing inclusions are formed, thereby decreasing the ductility of the steel. Therefore, the zirconium content in the steel rail is limited to 0.20 mass %.

Aluminium (Al) deoxidizes the steel and inhibits the formation of proeutectoid cementite during cooling from the austenite phase field, thereby increasing the ductility of the rail. However, if the aluminium content exceeds 1.0 mass %, coarse aluminium oxides form and degrade the ductility of the steel. Therefore, the aluminium content in the steel rail is limited to 1.0 mass %.

Tungsten (W) forms carbide compounds that can increase the strength and wear resistance of the rail. However, when the tungsten content exceeds 1.0 mass %, coarse compounds may form and brittle martensite may be promoted, impairing the ductility of the steel. Therefore, the tungsten content in the steel rail is limited to 1.0 mass %.

Examples

In a first example of an embodiment of this invention, a high carbon steel rail comprising 0.75-0.85 mass % of carbon, 0.1-1.5 mass % of silicon, 0.01-0.3 mass % of manganese, 0.1-1.5 mass % of Cr, and 0.005-0.05 mass % of titanium was manufactured. The manufacturing process comprised continuous casting of a bloom, rolling the bloom into a rail shape at a temperature where the structure was austenitic, accelerated cooling of the austenitic structure of the rail head to below the pearlite transformation temperature comprising flowing a gas over the surface of the rail head 10, and final cooling of the rail to ambient temperature through ambient cooling, thus achieving a microstructure comprising at least 90% pearlite at a depth of between 2-20 mm below the rail head surface 10 and a rail head surface 10 hardness of at least 325 HB. For the purpose of demonstration only, the mechanical property ranges achieved were: rail head surface 10 hardness between 390-480 HB, tensile strength between 185,000-210,000 psi, yield strength between 125,000-155,000 psi, total elongation between 10-16%, and reduction of area between 18-38%.

In a second example of an embodiment of this invention, a high carbon pearlitic steel rail comprising 0.75-0.85 mass % of carbon, 0.5-1.5 mass % of silicon, 0.01-0.4 mass % of manganese, 0.1-1.5 mass % of Cr, and 0.005-0.05 mass % of titanium was manufactured. The manufacturing process comprised continuous casting of a bloom, rolling the bloom into a rail shape at a temperature where the structure was austenitic, accelerated cooling of the austenitic structure of the rail head to below the pearlite transformation temperature comprising flowing a gas over the surface of the rail head 10, and final cooling of the rail to ambient temperature through ambient cooling, thus achieving a microstructure comprising at least 90% pearlite at a depth of between 2-20 mm below the rail head surface 10 and a rail head surface 10 hardness of at least 325 HB. For the purpose of demonstration only, the mechanical property ranges achieved were: rail bead surface 10 hardness between 390-480 HB, tensile strength between 185,000-210,000 psi, yield strength between 125,000-155,000 psi, total elongation between 10-16%, and reduction of area between 18-38%.

Figure 2:
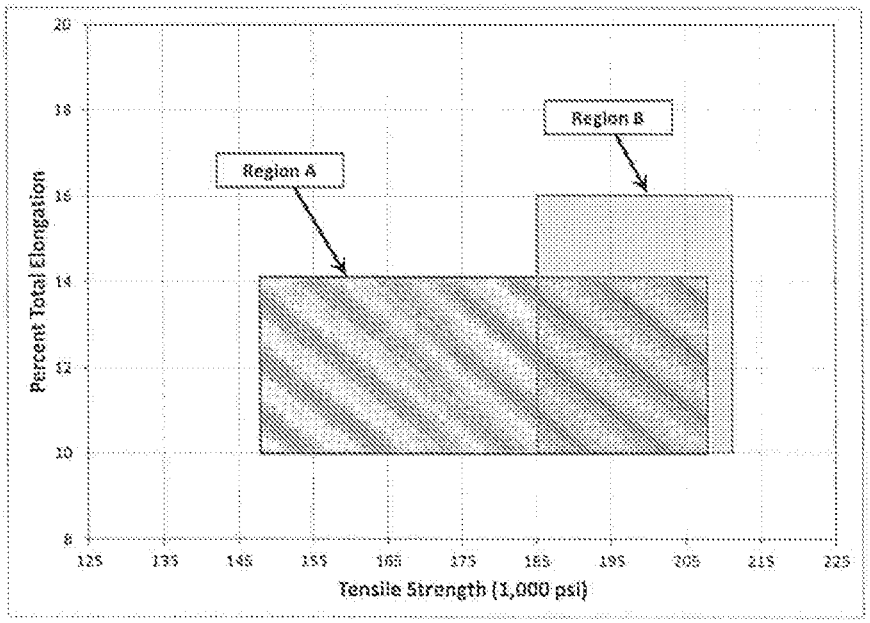
FIG. 2 depicts the approximate values of percent total elongation and tensile strength for high carbon pearlitic steel rails. Region A corresponds approximately to the property range of conventional C—Mn steel rails. Region B corresponds approximately to the first and second example embodiments of steel rails of the current invention.
Figure 3:
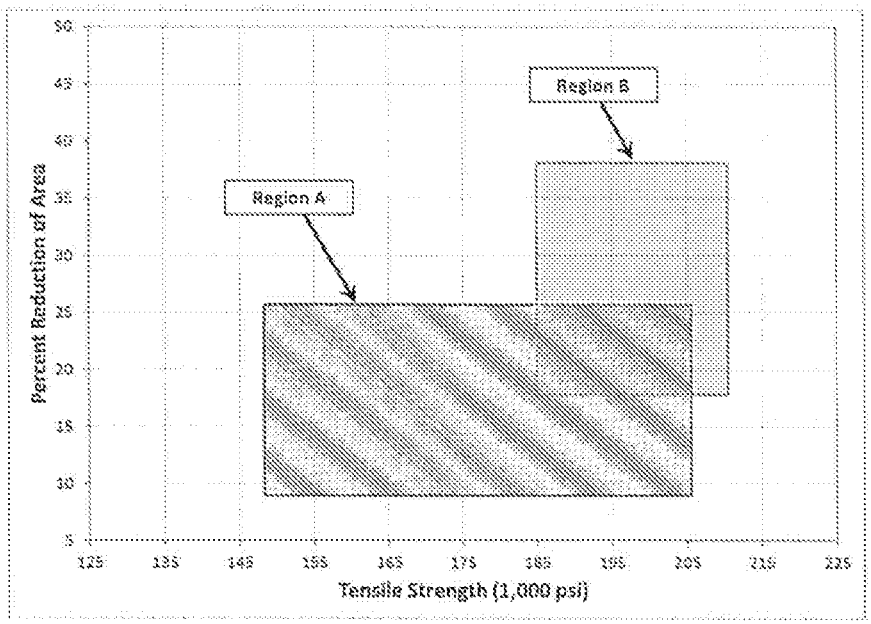
FIG. 3 depicts the approximate values of percent reduction of area and tensile strength for high carbon pearlitic steel rails. Region A corresponds approximately to the properly range of conventional C—Mn steel rails. Region B corresponds approximately to the first and second example embodiments of steel rails of the current invention.
Figure 4:
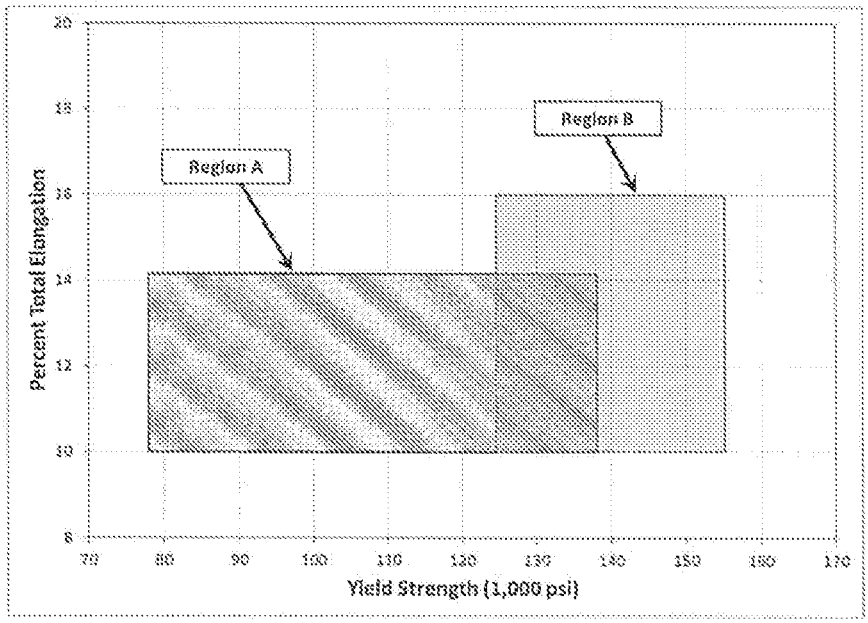
FIG. 4 depicts the approximate values of percent total elongation and yield strength for high carbon pearlitic steel rails. Region A corresponds approximately to the property range of conventional C—Mn steel rails. Region B corresponds approximately to the first and second example embodiments of steel rails of the current invention.
Figure 5:
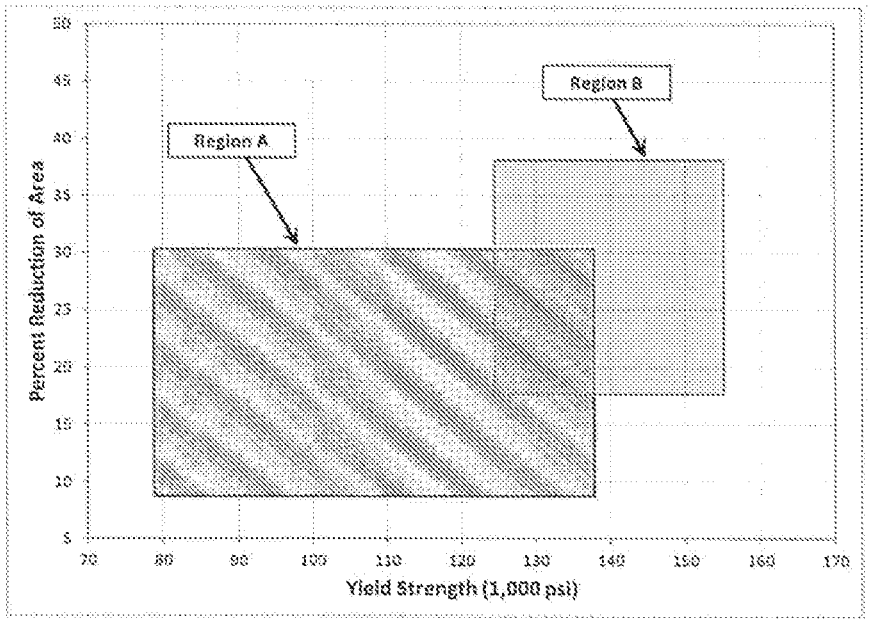
FIG. 5 depicts the approximate values of percent reduction of area and yield strength for high carbon pearlitic steel rails. Region A corresponds approximately to the property range of conventional C—Mn steel rails. Region B corresponds approximately to the first and second example embodiments of steel rails of the current invention.
Figure 6:
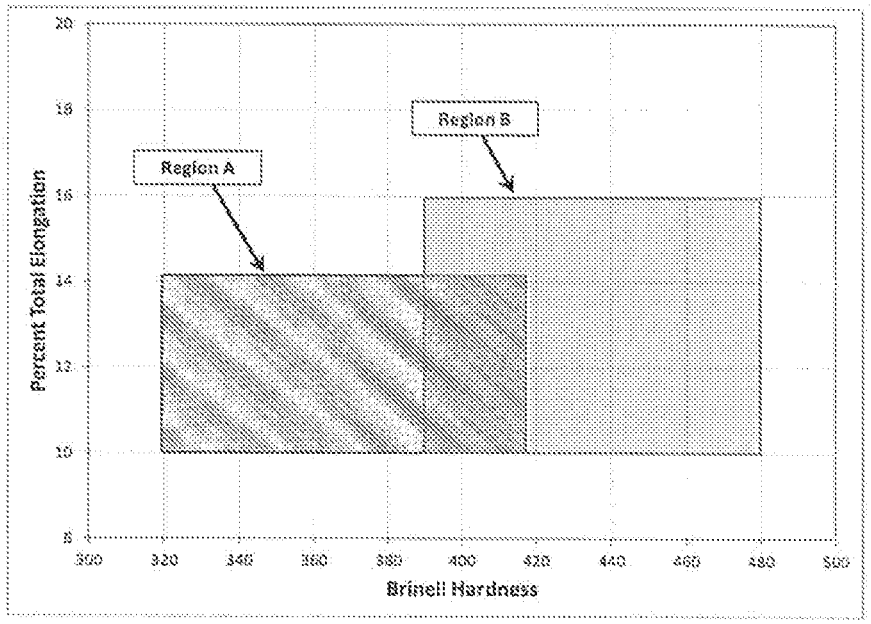
FIG. 6 depicts the approximate values of percent total elongation and rail head surface Brinell hardness (HB) for high carbon pearlitic steel rails. Region A corresponds approximately to the property range of conventional C—Mn steel rails. Region B corresponds approximately to the first and second example embodiments of steel rails of the current invention.
Figure 7:
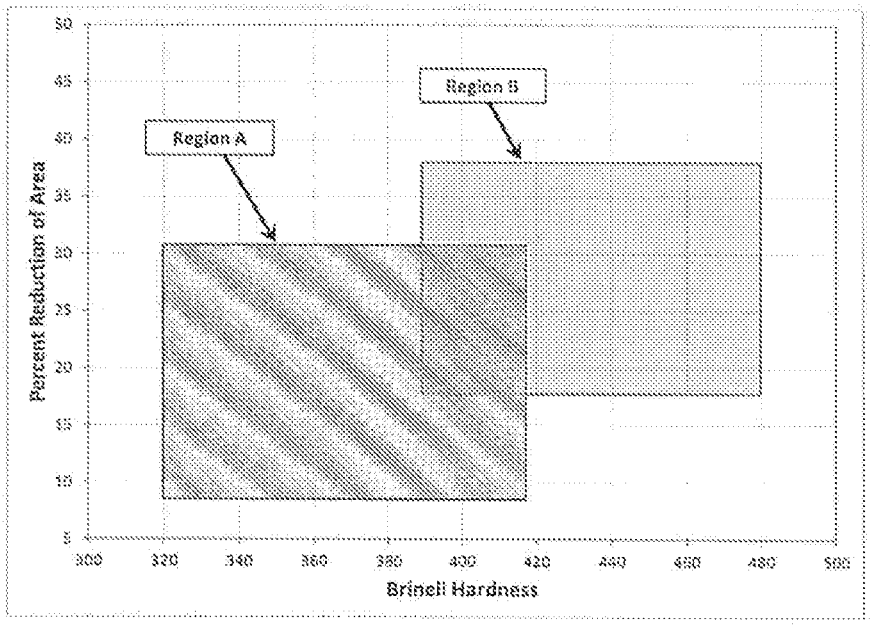
FIG. 7 depicts the approximate values of percent reduction of area and rail head surface Brinell hardness (HB) for high carbon pearlitic steel rails. Region A corresponds approximately to the property range of conventional C—Mn steel rails. Region B corresponds approximately to the first and second example embodiments of steel rails of the current invention.

These two embodiments show that the present invention, comprising high carbon steel rail compositions and the method of manufacturing rails of such compositions to achieve a rail head surface 10 hardness of at least 325 HB and a microstructure comprising at least 90% pearlite at a depth of between 2-20 mm below the rail head surface 10, is useful in that it produces railroad rails with properties meeting or exceeding conventional C—Mn steel railroad rails (FIG. 2-7). However, these two embodiments are included only as examples to demonstrate the improved combinations of mechanical properties (rail head surface 10 hardness, yield strength, tensile strength, total elongation, and reduction of area) that can be achieved using the present invention; the two embodiments relate specifically to higher strength railroad rail applications. Nonetheless, it will be appreciated by those skilled in the art that other manifestations of beneficial and useful mechanical property combinations can be achieved utilizing the claimed invention. For example, by utilizing different combinations of elements comprising the steel rail compositions within the composition ranges claimed, and/or by utilizing different manufacturing parameters within the scope of the method of production claimed, it would be possible to achieve pearlitic steel rails with properties differing from the two example embodiments, such as: lower yield strength or higher yield strength, lower tensile strength or higher tensile strength, lower rail head surface 10 hardness or higher rail head surface 10 hardness, lower total elongation or higher total elongation, and/or lower reduction of area or higher reduction of area. Such steel rails would still be useful for railroad rail applications under the current invention, as long as the selected combination of composition and manufacturing method produce a microstructure comprising at least 90% pearlite at a depth of between 2-20 mm below the rail head surface 10, with a rail head surface 10 hardness of at least 325 HB.

In one embodiment it is preferable for the high carbon steel rail to have a microstructure comprising at least 90% pearlite at a depth of between 2-20 mm below the rail head surface 10, since a pearlite microstructure results in combinations of hardness, strength, ductility, and wear resistance that are suitable for use in freight railway rail applications.

In another embodiment it is preferable for the high carbon steel rail to have a rail head surface 10 with a hardness of at least 325 HB to improve the wear resistance of the rail and improve the performance of the rail in freight railways, since higher surface hardness has been correlated with improved wear resistance in pearlitic steels (for example U.S. Pat. No. 5,762,723).

A fine pearlite interlamellar spacing increases the hardness of the steel rail and improves the wear resistance (for example U.S. Pat. No. 5,762,723). Therefore, for example, it is preferable for the pearlite interlamellar spacing to be 500 nm or less. A pearlite interlamellar spacing greater than 500 nm may not result in sufficiently high hardness, thus degrading the performance of the steel rail.

It is preferable for the high carbon steel rail to have a yield strength of at least 75,000 psi, because yield strengths below 75,000 psi may result in plastic deformation of the rail in service, thus degrading the performance of the steel rail.

It is preferable for the high carbon steel rail to have a tensile strength of at least 140,000 psi, because tensile strengths below 140,000 psi may limit the load carrying capacity of the rail, thus degrading the performance of the steel rail.

It is preferable for the high carbon steel rail to have a total elongation of at least 10%, because total elongation values below 10% may indicate that the rail is embrittled, thus degrading the performance of the high carbon steel rail.

It is preferable for the high carbon steel rail to have a reduction of area of at least 10%, because reduction of area values below 10% may indicate that the rail is embrittled, thus degrading the performance of the high carbon steel rail.

It is preferable for the above tensile properties (yield strength, tensile strength, total elongation, and reduction of area) to be determined from tensile specimens with a gauge section that lies within a depth of 15 mm below the rail head surface 10, since mechanical properties within a depth of 15 mm below the rail head surface 10 may relate to the performance of the rail in freight railway applications. The tensile tests should be performed on tensile specimens whose long axis is parallel to the length of the rail.

The rail product described herein in one embodiment was produced from steel blooms cast from liquid steel in either a typical melting furnace or a typical ore refining furnace, through a continuous casting or an ingot casting route, or extruded in a manner well known in the art and then roughly rolled. For example, the rails would be roughly rolled into rail-shaped semi-finished products, and then finished into rails. By way of example only, the temperature at which breakdown rolling is finished is above 800° C. with an austenitic structure, depending on the alloy composition selected and the properties desired as described herein. Thereafter the finished rail or any portion of the rail, which is comprised of the austenitic structure present after rolling or an austenitic structure resulting from heating a cooled rail to above the austenite formation temperature, is cooled to a temperature below the pearlite transformation temperature at a cooling rate sufficient to achieve a hardness of at least 325 HB on the surface of the rail head 10 while generating a microstructure comprising at least 90% pearlite at a depth of between 2-20 mm below the rail head surface 10, where the cooling is achieved through ambient cooling and/or accelerated cooling comprising spraying, immersing, and/or flowing a cooling media across the entire surface or any portion of the surface of the rail 2, and subsequently cooling the rail to ambient temperature. By way of example only, the pearlite transformation temperature is below approximately 730° C. depending on alloy content and processing history, and desirable pearlitic microstructures and mechanical properties may be achieved if the pearlite transformation is carried out in a temperature range between 500-700° C., depending on the alloy composition selected and the properties desired as described herein.

In one embodiment, the steel rail carbon content is between 0.65-1.4 mass % the silicon content is between 0.1-1.5 mass %, the manganese content is between 0.01-0.3 mass %, the chromium content is between 0.1-1.5 mass %, and the titanium content is between 0.005-0.05 mass %, with the remainder comprising iron and the unavoidable impurities. Additionally, the hardness of the steel rail head surface 10 is a minimum of 325 HB. In one aspect the microstructure comprises at least 90% pearlite at a depth of between 2-20 mm below the rail head surface 10.

In another embodiment, the steel rail carbon content is between 0.65-0.75 mass %, the silicon content is between 0.1-1.5 mass %, the manganese content is between 0.01-0.3 mass %, the chromium content is between 0.1-1.5 mass %, and the titanium content is between 0.005-0.05 mass %, with the remainder comprising iron and the unavoidable impurities. Additionally, the hardness of the steel rail head surface 10 is a minimum of 325 HB. In one aspect the microstructure comprises at least 90% pearlite at a depth, of between 2-20 mm below the rail head surface 10.

In another embodiment, the steel rail carbon content is between 0.75-0.85 mass %, the silicon content is between 0.1-1.5 mass %, the manganese content is between 0.01-0.3 mass %, the chromium content is between 0.1-1.5 mass %, and the titanium content is between 0.005-0.05 mass %, with the remainder comprising iron and the unavoidable impurities. Additionally, the hardness of the steel rail head surface 10 is a minimum of 325 HB. In one aspect the microstructure comprises at least 90% pearlite at a depth of between 2-20 mm below the rail head surface 10.

In another embodiment, the steel rail carbon content is between 0.85-1.0 mass %, the silicon content is between 0.1-1.5 mass %, the manganese content is between 0.01-0.3 mass %, the chromium content is between 0.1-1.5 mass %, and the titanium content is between 0.005-0.05 mass %, with the remainder comprising iron and the unavoidable impurities. Additionally, the hardness of the steel rail head surface 10 is a minimum of 325 HB. In one aspect the microstructure comprises at least 90% pearlite at a depth of between 2-20 mm below the rail head surface 10.

In another embodiment, the steel rail carbon content is between 1.0-1.2 mass %, the silicon content is between 0.1-1.5 mass %, the manganese content is between 0.01-0.3 mass %, the chromium content is between 0.1-1.5 mass %, and the titanium content is between 0.005-0.05 mass %, with the remainder comprising iron and the unavoidable impurities. Additionally, the hardness of the steel rail head surface 10 is a minimum of 325 HB. In one aspect the microstructure comprises at least 90% pearlite at a depth of between 2-20 mm below the rail head surface 10.

In yet another embodiment, the steel rail carbon content is between 0.65-1.4 mass %, the silicon content is between 0.5-1.5 mass %, the manganese content is between 0.01-0.4 mass %, the chromium content is between 0.1-1.5 mass %, and the titanium content is between 0.005-0.05 mass %, with the remainder comprising iron and the unavoidable impurities. Additionally, the hardness of the steel rail head surface 10 is a minimum of 325 HB. In one aspect the microstructure comprises at least 90% pearlite at a depth of between 2-20 mm below the rail head surface 10.

In still another embodiment, the steel rail carbon content is between 0.65-0.75 mass %, the silicon content is between 0.5-1.5 mass %, the manganese content is between 0.01-0.4 mass %, the chromium content is between 0.1-1.5 mass %, and the titanium content is between 0.005-0.05 mass %, with the remainder comprising iron and the unavoidable impurities. Additionally, the hardness of the steel rail head surface 10 is a minimum of 325 HB. In one aspect the microstructure comprises at least 90% pearlite at a depth of between 2-20 mm below the rail head surface 10.

In still another embodiment, the steel rail carbon content is between 0.75-0.85 mass %, the silicon content is between 0.5-1.5 mass %, the manganese content is between 0.01-0.4 mass %, the chromium content is between 0.1-1.5 mass %, and the titanium content is between 0.003-0.05 mass %, with the remainder comprising iron and the unavoidable impurities. Additionally, the hardness of the steel rail head surface 10 is a minimum of 325 HB. In one aspect the microstructure comprises at least 90% pearlite at a depth of between 2-20 mm below the rail head surface 10.

In still another embodiment the steel rail carbon content is between 0.85-1.0 mass %, the silicon content is between 0.5-1.5 mass %, the manganese content is between 0.01-0.4 mass %, the chromium content is between 0.1-1.5 mass %, and the titanium content is between 0.005-0.05 mass %, with the remainder comprising iron and the unavoidable impurities. Additionally, the hardness of the steel rail head surface 10 is a minimum of 325 HB. In one aspect the microstructure comprises at least 90% pearlite at a depth of between 2-20 mm below the rail head surface 10.

In still another embodiment, the steel rail carbon content is between 1.0-1.2 mass %, the silicon content is between 0.5-1.5 mass %, the manganese content is between 0.01-0.4 mass %, the chromium content is between 0.1-1.5 mass %, and the titanium content is between 0.005-0.05 mass %, with the remainder comprising iron and the unavoidable impurities. Additionally, the hardness of the steel rail head surface 10 is a minimum of 325 HB. In one aspect the microstructure comprises at least 90% pearlite at a depth of between 2-20 mm below the rail head surface 10.

The invention further embodies the above steel rail compositions and characteristics, with additional allowances for up to 0.5 mass % of molybdenum, up to 0.05 mass % of niobium, up to 0.3 mass % of vanadium, up to 1.0 mass % of copper, up to 1.0 mass % of nickel, up to 1.0 mass % of cobalt, up to 0.005 mass % of boron, up to 0.025 mass % of nitrogen, up to 0.02 mass % of calcium, up to 0.02 mass % of magnesium, up to 0.2 mass % of zirconium, up to 1.0 mass % of aluminium, and/or up to 1.0 mass % of tungsten.

Furthermore in other embodiments, excellent results exhibiting the beneficial properties were achieved by utilizing 0.5 mass % to 1.5 mass % Cr in the various embodiments described herein.

Furthermore in other embodiments, excellent results exhibiting the beneficial properties were achieved by utilizing 0.3 mass % to 0.4 mass % Mn in various embodiments described herein.

In some embodiments, the rail head surface 10 hardness is at least 325 HB to improve the wear resistance of the high carbon steel rail. In other embodiments, the rail head surface 10 hardness is at least 340 HB to further improve the wear resistance of the high carbon steel rail. In other embodiments, the rail head surface 10 hardness is at least 355 HB to additionally improve the wear resistance of the high carbon steel rail. In other embodiments, the rail head surface 10 hardness is at least 370 HB to additionally improve the wear resistance of the high carbon steel rail. In other embodiments, the rail head surface 10 hardness is at least 385 HB to additionally improve the wear resistance of the high carbon steel rail. In other embodiments, the rail head surface 10 hardness is at least 400 HB to additionally improve the wear resistance of the high carbon steel rail. In other embodiments, the rail head surface 10 hardness is at least 415 HB to additionally improve the wear resistance of the high carbon steel rail. In other embodiments, the rail head surface 10 hardness is at least 430 HB to additionally improve, the wear resistance of the high carbon steel rail. In other embodiments, the rail head surface 10 hardness is at least 445 HB to additionally improve the wear resistance of the high carbon steel rail. In other embodiments, the rail head surface 10 hardness is at least 460 HB to additionally improve the wear resistance of the high carbon steel rail.

In some embodiments, the pearlite interlamellar spacing is 500 nm or less to improve the hardness and wear resistance of the rail. In other embodiments, the pearlite interlamellar spacing is 300 nm or less for additional improvement in hardness and wear resistance. In still other embodiments, the pearlite interlamellar spacing is 150 nm or less for yet additional improvements in hardness and wear resistance.

In some embodiments, the yield strength is at least 75,000 psi to increase the resistance to plastic deformation of the high carbon steel rail. In other embodiments, the yield strength is at least 80,000 psi to further increase the resistance to plastic deformation of the high carbon steel rail. In other embodiments, the yield strength is at least 90,000 psi to further increase the resistance to plastic deformation of the high carbon steel rail. In other embodiments, the yield strength is at least 100,000 psi to further increase the resistance to plastic deformation of the high carbon steel rail. In other embodiments, the yield strength is at least 110,000 psi to further increase the resistance to plastic deformation of the high carbon steel rail. In other embodiments, the yield strength is at least 120,000 psi to further increase the resistance to plastic deformation of the high carbon steel rail. In other embodiments, the yield strength is at least 130,000 psi to further increase the resistance to plastic deformation of the high carbon steel rail. In other embodiments, the yield strength is at least 140,000 psi to further increase the resistance to plastic deformation of the high carbon steel rail. In other embodiments, the yield strength is at least 150,000 psi to further increase the resistance to plastic deformation of the high carbon steel rail.

In some embodiments, the tensile strength is at least 140,000 psi to increase the load carrying capacity of the high carbon steel rail. In other embodiments, the tensile strength is at least 150,000 psi to further increase the load carrying capacity of the high carbon steel rail. In other embodiments, the tensile strength is at least 160,000 psi to further increase the load carrying capacity of the high carbon steel rail. In other embodiments, the tensile strength is at least 170,000 psi to further increase the load carrying capacity of the high carbon steel rail. In other embodiments, the tensile strength is at least 180,000 psi to further increase the load carrying capacity of the high carbon steel rail. In other embodiments, the tensile strength is at least 190,000 psi to further increase the load carrying capacity of the high carbon steel rail. In other embodiments, the tensile strength is at least 200,000 psi to further increase the load carrying capacity of the high carbon steel rail. In other embodiments, the tensile strength is at least 210,000 psi to further increase the load carrying capacity of the high carbon steel rail.

In some embodiments, the total elongation is at least 10% to ensure that the high carbon steel rail will be sufficiently ductile.

In some embodiments, the reduction of area is at least 10% to ensure that the high carbon steel rail will be sufficiently ductile. In other embodiments, the reduction, of area is at least 14% to further ensure that the high carbon steel rail will be sufficiently ductile. In other embodiments, the reduction of area is at least 18% to further ensure that the high carbon steel rail will be sufficiently ductile. In other embodiments, the reduction of area is at least 22% to further ensure that the high carbon steel rail will be sufficiently ductile. In other embodiments, the reduction of area is at least 26% to further ensure that the high carbon steel rail will be sufficiently ductile. In other embodiments, the reduction of area is at least 30% to further ensure that the high carbon steel rail will be sufficiently ductile. In other embodiments, the reduction of area is at least 34% to further ensure that the high carbon steel rail will be sufficiently ductile. In other embodiments, the reduction of area is at least 38% to further ensure that the high carbon steel rail will be sufficiently ductile. In other embodiments, the reduction of area is at least 42% to farther ensure that the high carbon steel rail will be sufficiently ductile.

The invention described herein also includes the process for manufacturing the high carbon steel rail comprising the above compositions and characteristics, where the manufacturing process consists of the steps of: forming a rail shape by rolling of an austenitic structure; cooling of the austenitic structure of the whole rail or any portion of the rail to below the pearlite transformation temperature at a cooling rate sufficient to achieve a hardness of at least 325 HB on the surface of the rail head 10 while generating a microstructure comprising at least 90% pearlite at a depth of between 2-20 mm below the rail head surface 10, where the austenite structure prior to pearlite transformation is either the austenite structure present after the rolling process or an austenite structure developed by reheating a cooled rail to above the austenite formation temperature, and the cooling is achieved either through ambient cooling and/or accelerated cooling comprising spraying, immersing, and/or flowing a cooling media across the entire surface or any portion of the surface of the rail 2; and further cooling the rail to ambient temperature.

In one embodiment of the above manufacturing process, the austenitic structure is cooled to below the pearlite transformation temperature at a cooling rate of between 0.25-50° C./s to achieve a microstructure comprising at least 90% pearlite at a depth of between 2-20 mm below the rail head surface 10 and a rail head surface 10 hardness of at least 325 HB. In another embodiment of the above manufacturing process, the austenitic structure is cooled to below the pearlite transformation temperature at a cooling rate of between 0.5-25° C./s to achieve a microstructure comprising at least 90% pearlite at a depth of between 2-20 mm below the rail head surface 10 and a rail head surface 10 hardness of at least 325 HB. In another embodiment, of the above manufacturing process, the austenitic structure is cooled to below the pearlite transformation temperature at a cooling rate of between 0.5-15° C./s to achieve a microstructure comprising at least 90% pearlite at a depth of between 2-20 mm below the rail head surface 10 and a rail head surface 10 hardness of at least 325 HB. In another embodiment of the above manufacturing process, the austenitic structure is cooled to below the pearlite transformation temperature at a cooling rate of between 0.5-10° C./s to achieve a microstructure comprising at least 90% pearlite at a depth of between 2-20 mm below the rail head surface 10 and a rail head surface 10 hardness of at least 325 HB. In another embodiment of the above manufacturing process, the austenitic structure is cooled to below the pearlite transformation temperature at a cooling rate of between 1.0-10° C./s to achieve a microstructure comprising at least 90% pearlite at a depth of between 2-20 mm below the rail head surface 10 and a rail head surface 10 hardness of at least 325 HB.

In one embodiment of the above manufacturing process, cooling of the austenitic structure to below the pearlite transformation temperature is achieved using ambient, cooling. In another embodiment of the above manufacturing process, cooling of the austenitic structure to below the pearlite transformation temperature is achieved using accelerated cooling, where the accelerated cooling is achieved by spraying, immersing, and/or flowing a cooling media across the entire surface or any portion of the surface of the rail 2. In this embodiment, the aforementioned cooling media comprises a gas, a liquid, or mixture of a gas and a liquid. The cooled microstructure comprises at least 90% pearlite at a depth of between 2-20 mm below the rail head surface 10 and the rail head surface 10 hardness of at least 325 HB.

In one embodiment of the above manufacturing process, accelerated cooling of the austenitic structure of the rail head to below the pearlite transformation temperature comprises flowing a gas at various pressures and/or flow rates across the surface of the rail head 10. In this embodiment of the above manufacturing process, subsequent to the accelerated cooling of the austenitic structure to below the pearlite transformation temperature, the rail is cooled to ambient temperature through ambient cooling, thus achieving a microstructure comprising at least 90% pearlite at a depth of between 2-20 mm below the rail head surface 10 and a rail head surface 10 hardness of at least 325 HB.

In another embodiment of the above manufacturing process, accelerated cooling of the austenitic structure of the rail head to below the pearlite transformation temperature comprises flowing a gas at various pressures and/or flow rates across the surface of the rail head 10 and optionally the surface of the rail web and/or the surface of the rail base. In this embodiment of the above manufacturing process, subsequent to the accelerated cooling of the austenitic structure to below the pearlite transformation temperature, the rail is cooled to ambient temperature through ambient cooling, thus achieving a microstructure comprising at least 90% pearlite at a depth of between 2-20 mm below the rail head surface 10 and a rail head surface 10 hardness of at least 325 HB.

Accordingly, a high carbon steel rail comprising 0.65-1.4 mass % of carbon, 0.1-1.5 mass % of silicon, 0.01-0.3 mass % of manganese, 0.1-1.5 mass % of chromium, and 0.005-0.05 mass % of titanium, with the remainder comprising iron and the inevitable impurities, was produced having superior characteristics to conventional C—Mn steel rails, namely improved combinations of strength, hardness, and ductility.

Additionally, a high carbon steel rail comprising 0.65-1.4 mass % of carbon, 0.5-1.5 mass % of silicon, 0.01-0.4 mass % of manganese, 0.1-1.5 mass % of chromium, and 0.005-0.05 mass % of titanium, with the remainder comprising iron and the inevitable impurities, was produced having superior characteristics to conventional C—Mn steel rails, namely improved combinations of strength, hardness, and ductility.

Although specific embodiments have been illustrated and described herein for purposes of description of preferred embodiments, it will be appreciated by those of ordinary skill in the art that other embodiments and implementations are possible within the scope of the invention. Accordingly the invention is not to be restricted except in light of the attached claims and their equivalents.

We claim:

1. A high carbon steel rail having a composition comprising:

0.65 mass % to 1.4 mass % C, 0.1 mass % to 1.5 mass % Si, 0.01 mass % to 0.3 mass % Mn, 0.62 mass % to 1.5 mass % Cr, 0.005 mass % to 0.05 mass % Ti, and the remainder being Fe and inevitable impurities, without the presence of rare earth metals, wherein a rail head surface hardness is at least 325 HB, and a microstructure comprises at least 90% pearlite at a depth of between 2-20 mm below the rail head surface.

2. The high carbon steel rail as claimed in claim 1 wherein the C comprises 0.65 mass % to 0.75 mass %.

3. The high carbon steel rail as claimed in claim 1 wherein the C comprises 0.75 mass % to 0.85 mass %.

4. The high carbon steel rail as claimed in claim 1 wherein the C comprises 0.85 mass % to 1.0 mass %.

5. The high carbon steel rail as claimed in claim 1 wherein the C comprises 1.0 mass % to 1.2 mass %.

6. A high carbon steel rail having a composition comprising:

0.65 mass % to 1.4 mass % C,
0.5 mass % to 1.5 mass % Si,
0.01 mass % to 0.4 mass % Mn,
0.62 mass % to 1.5 mass % Cr,
0.005 mass % to 0.05 mass % Ti, and
the remainder being Fe and inevitable impurities, without the presence of rare earth metals, wherein a rail head surface hardness is at least 325 HB, and a microstructure comprises at least 90% pearlite at a depth of between 2-20 mm below the rail head surface.

7. The high carbon steel rail as claimed in claim 6 wherein the C comprises 0.65 mass % to 0.75 mass %.

8. The high carbon steel rail as claimed in claim 6 wherein the C comprises 0.75 mass % to 0.85 mass %.

9. The high carbon steel rail as claimed in claim 6 wherein the C comprises 0.85 mass % to 1.0 mass %.

10. The high carbon steel rail as claimed in claim 6 wherein the C comprises 1.0 mass % to 1.2 mass %.

11. The high carbon steel rail having a composition as claimed in either of claim 1 or 6 further comprising of one or more of: up to 0.5 mass % Mo, up to 0.05 mass % Nb, up to 0.3 mass % V, up to 1.0 mass % Cu, up to 1.0 mass % Ni, up to 1.0 mass % Co, up to 0.005 mass % B, up to 0.025 mass % N, up to 0.02 mass % Ca, up to 0.02 mass % Mg, up to 0.2 mass % Zr, up to 1.0 mass % Al, and/or up to 1.0 mass % W.

12. A process for manufacturing a high carbon steel having a composition as claim in either of claim 1 or 6 comprising the steps of:

forming a rail shape by rolling of an austenitic structure;
cooling of the austenitic structure of the entire rail or any portion of the rail to below a pearlite transformation temperature at a cooling rate sufficient to achieve a hardness of at least 325 HB on a surface of a rail head while generating a microstructure that comprises at least 90% pearlite at a depth of between 2-20 mm below the rail head surface, where the austenite structure prior to pearlite transformation is either the austenite structure present after the rolling process or an austenite structure developed by reheating a cooled rail to above an austenite formation temperature, and the cooling is achieved either through ambient cooling and/or accelerated cooling by spraying, immersing, and/or flowing a cooling media across the entire surface or any portion of the surface of the rail; and
further cooling the rail to ambient temperature.

* * * * *